US005134788A

United States Patent [19]

Stibbe et al.

[11] Patent Number: 5,134,788

[45] Date of Patent: Aug. 4, 1992

[54] DRYER APPARATUS FOR FLOATING A RUNNING WEB AND HAVING AN EXHAUST FLOW RATE CONTROL SYSTEM

[75] Inventors: Paul H. Stibbe, DePere; Stephen E. Dobson, Green Bay, both of Wis.

[73] Assignee: Advance Systems Inc., Green Bay, Wis.

[21] Appl. No.: 630,830

[22] Filed: Dec. 20, 1990

[51] Int. Cl.[5] ..... F26B 13/10

[52] U.S. Cl. ..... 34/44; 34/51; 34/52; 34/156; 34/54

[58] Field of Search ..... 34/54, 156, 44, 51, 34/52, 155

[56] References Cited

U.S. PATENT DOCUMENTS

| | | | |
|---|---|---|---|
| 2,955,342 | 10/1960 | Litzler et al. | 34/54 |
| 4,087,568 | 5/1978 | Fay | 34/52 |
| 4,146,974 | 4/1979 | Pray | 34/54 |
| 4,150,495 | 4/1979 | Stern | 34/54 |
| 4,204,337 | 5/1980 | Roos et al. | 34/52 |
| 4,233,901 | 11/1980 | Mallinson | 34/77 |
| 4,343,096 | 8/1982 | Bergland | 34/77 |
| 4,413,427 | 11/1983 | Villalobos et al. | 34/54 |
| 4,414,755 | 11/1983 | Ericsson | 34/54 |
| 4,502,228 | 3/1985 | Helbig et al. | 34/54 |
| 4,575,952 | 3/1986 | Bodenan et al. | 34/54 |
| 4,833,794 | 5/1989 | Stibbe et al. | 34/156 |
| 4,942,676 | 7/1990 | Wimberger et al. | 34/51 |

*Primary Examiner*—Henry A. Bennett
*Assistant Examiner*—Denise L. F. Gromada
*Attorney, Agent, or Firm*—Nilles & Nilles

[57] ABSTRACT

Web drying equipment, including a dryer through which a web passes, web drying nozzles within the dryer for directing heated air against the web, air supply header means in the dryer and in air delivering communication with the nozzles which discharge heated air toward the web for supporting and drying the web, an exhaust air duct extending from the interior of the dryer for conveying spent air therefrom. An exhaust flow rate control system is provided for controlling the rate of flow of the spent air from the dryer including (1) a valve in the exhaust duct for varying the rate of air flow from the dryer, (2) a controller for operating the valve, (3) a sensor located in the exhaust duct for measuring air pressure therein and for sending a corresponding signal to the controller, (4) a speed sensor for measuring the speed of the web passing through the dryer and sending a corresponding signal to the controller. The controller actuates the exhaust duct valve means in accordance with the signals received from the speed sensor and the air pressure sensor.

6 Claims, 4 Drawing Sheets

DRYER APPARATUS FOR FLOATING A RUNNING WEB AND HAVING AN EXHAUST FLOW RATE CONTROL SYSTEM

BACKGROUND OF THE INVENTION

1. Field of the Invention

The invention relates to apparatus for floatingly suspending and guiding a running web of indeterminate length through an elongated dryer. More particularly the invention relates to a control system for controlling the exhaust flow rate of air from the dryer and in which the exhaust flow rate requirement is directly related to the press speed.

2. Background Information

In high velocity web dryers, safe dryer design requires that the exhaust system must be capable of handling the worst possible condition for solvent laden air. This "worst case" condition would occur at a web speed equal to the printing press maximum web speed while laying down maximum solvent onto the paper. Maximum web speed would draw the most solvent laden paper through the dryer while the heaviest lay down has the highest concentration of solvent. The exhaust system's purpose is to remove this solvent from the dryer as it is evaporated from the web. This exhaust flow out of the dryer must be sufficient to remove the solvent laden air under the worst condition of operation.

The present invention is utilized with dryer apparatus of the type shown in U.S. Pat. No. 4,833,794 issued May 30, 1989, to Stibbe, et al, U.S. Pat. No. 4,787,547 issued Nov. 29, 1988 to Hella, et al, or in U.S. Pat. No. 4,116,620 issued Sep. 26, 1978 to Stibbe. These high velocity web dryers all utilize air bars for floatingly suspending the running web as it moves through an elongated housing and have exhaust systems for exhausting the solvent laden air from the housing. Prior art devices use various means to determine the correct exhaust flow rate of the air. Many of these systems use energy which is based on the air flow through the system and not particularly on the solvent content of the air.

In actual practice, presses rarely reach their maximum speeds, generally running at 60% to 80% of maximum speed. This reduction in speed directly reflects the concentration of solvent in the air.

A reduction of exhaust rates has several benefits to the printer. Since the exhaust system is removing heated air from the dryer, less energy is required to maintain a set temperature because less heat would be removed.

When air is exhausted from the dryer, other air must take its place. This "make-up" air is drawn from the room area surrounding the dryer. This room air, in turn, must also be replaced, and usually this replacement air is drawn from outside the plant, meaning it must be heated or cooled to maintain a comfortable working environment. Reducing this air inflow to the plant will reduce the printers heating/cooling cost.

Furthermore, printers are generally required to include pollution control devices on their exhaust systems. A majority of systems currently on the market use energy based on air flow through the system, not just the solvent content of the air. By reducing the air flow, the printer would save additional expense.

SUMMARY OF THE INVENTION

The present invention provides web dryer apparatus for floatingly suspending and guiding a running web of indeterminate length through an elongated dryer and more particularly provides an exhaust flow rate control system for such a dryer. More specifically, the exhaust flow rate control system of the present invention relates the exhaust requirement of the dryer apparatus directly to the speed of the printing press. The control system incorporates a sensor to read the press speed, a sensor to read the air pressure in the exhaust system, both sensors having an input into a computerized controller, and a motorized damper operated by the controller via a positioning motor, to adjust the airflow until it matches the required value. A more specific aspect of the invention relates to such a system having computer software controlled means for allowing for great versatility at less cost.

DESCRIPTION OF A PREFERRED EMBODIMENT

Figure 1:
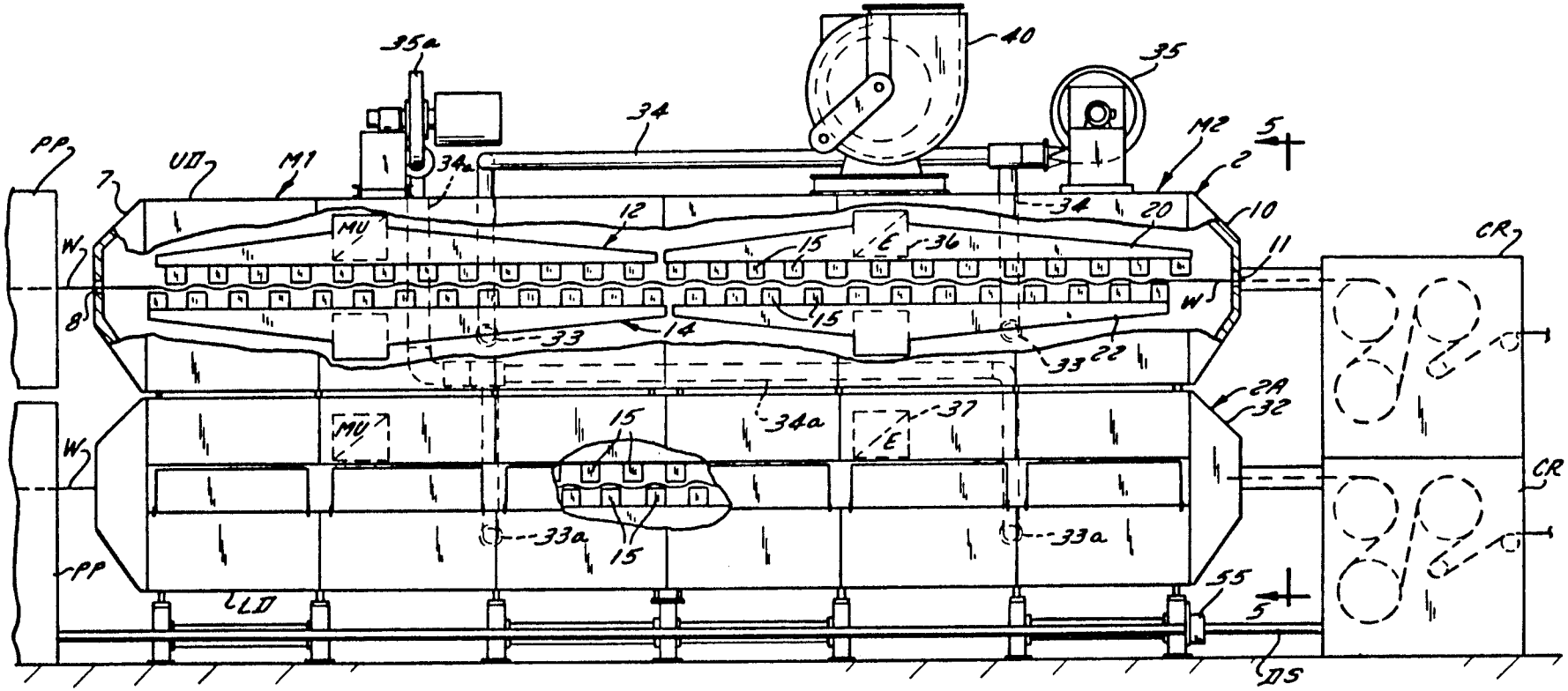
FIG. 1 is a side elevational, schematic view of a double web dryer, as one example only of where the present invention finds utility, certain parts being shown as broken away or removed for the sake of clarity in the drawings.

FIG. 1 shows a two-pass dryer system, that is, two webs being dried in their respective dryers, one arranged above the other, as for example, as shown in said U.S. Pat. No. 4,833,794. The webs W enter their upper and lower dryers UD and LD from their conventional printing presses PP and then after passing through the dryer and being dried, the webs then enter a set of conventional chill rolls CR located at the exit end of the dryers. A press drive shaft DS extends from the presses and extends along the underside of the dryers to drivingly connect with the chill rolls for driving the latter in the known manner.

Because the structure and operation of the upper dryer UD and lower dryer LD having housing 2 and **2*a***, respectively, are the same, only one of such dryer, the upper one, will now be described in detail.

Figure 3:
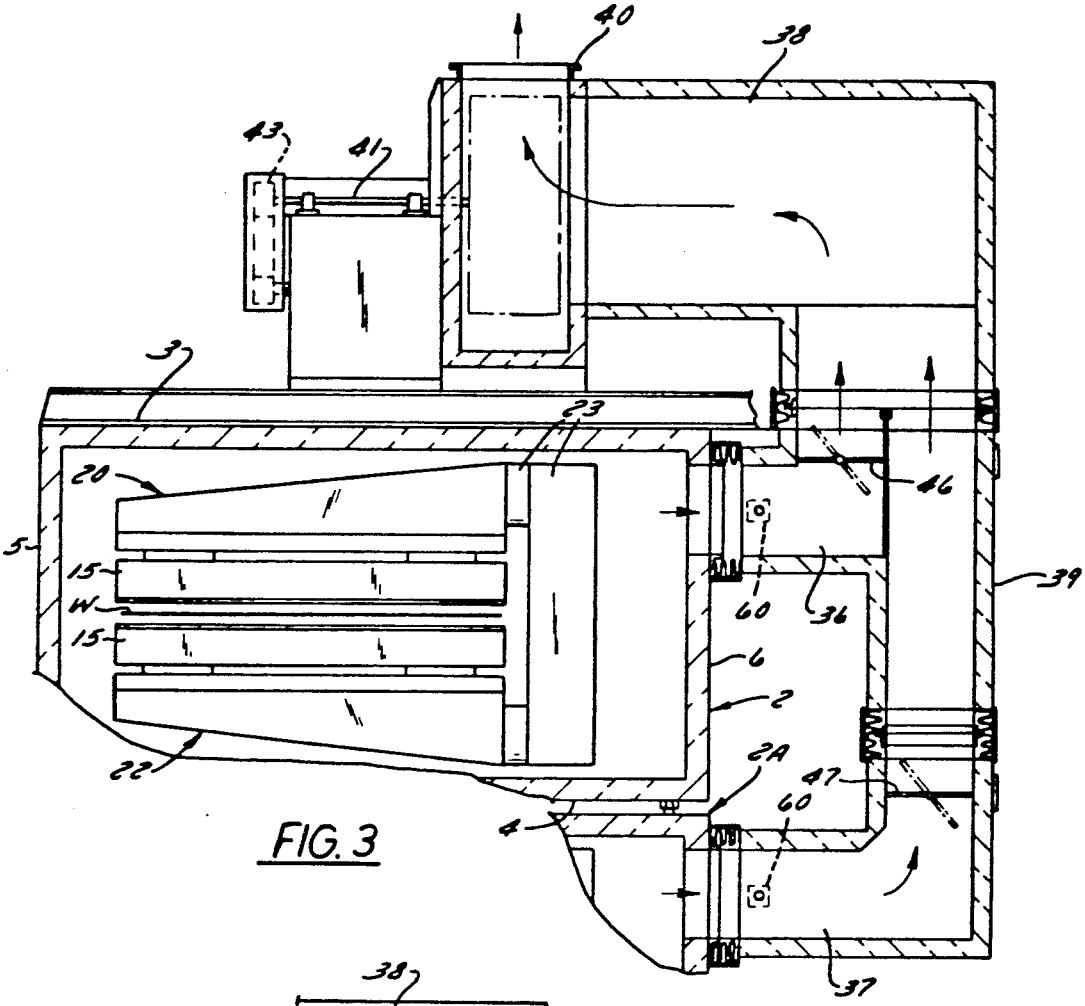
FIG. 3 is a vertical cross sectional view taken generally along the line 3—3 in FIG. 2, certain parts being shown as broken away or removed for the sake of clarity.

The web drying apparatus for floatingly suspending a running web shown in FIG. 1 includes an elongated upper dryer housing 2 which is enclosed by its insulated top 3 (FIG. 3), insulated bottom 4, one insulated side 5, and an opposite insulated side 6. An insulated inlet end 7 has a horizontal slot 8 through which the web W enters. The opposite, exit end is formed by the insulated end wall 10 and a corresponding slot 11 therein through which the web exits. In the FIG. 1 showing, two similar housing modules M1 and M2 are joined together end to end. A single module such as shown in U.S. Pat. No. 4,833,794 may be used in some installations. The length of a module may vary, for example, from eleven to twenty feet, but a length of twelve to fourteen feet would be average.

The arrangement includes an upper air bar assembly 12 and a lower air bar assembly 14 between which the web W passes. Assemblies 12 and 14 each have a series of air bars 15 located in spaced apart relationship along each of the upper and lower sides of the web and these bars are transversely positioned across the web. It will be noted that the upper air bars are in staggered, spaced relationship along the web with respect to the lower air bars to thereby cause the web to assume a conventional sine wave form when in operation, as shown.

An air supply duct means 20 is provided for each module of the upper air bars 15 while a similar air supply duct means 22 is provided for the lower set of air bars 15. These duct means include the longitudinally extending ducts 23 that extend from the central supply duct 24. The ducts 23 are in air delivering communication with the air bars, as is conventional and shown in U.S. Pat. No. 4,787,547.

Figure 2:
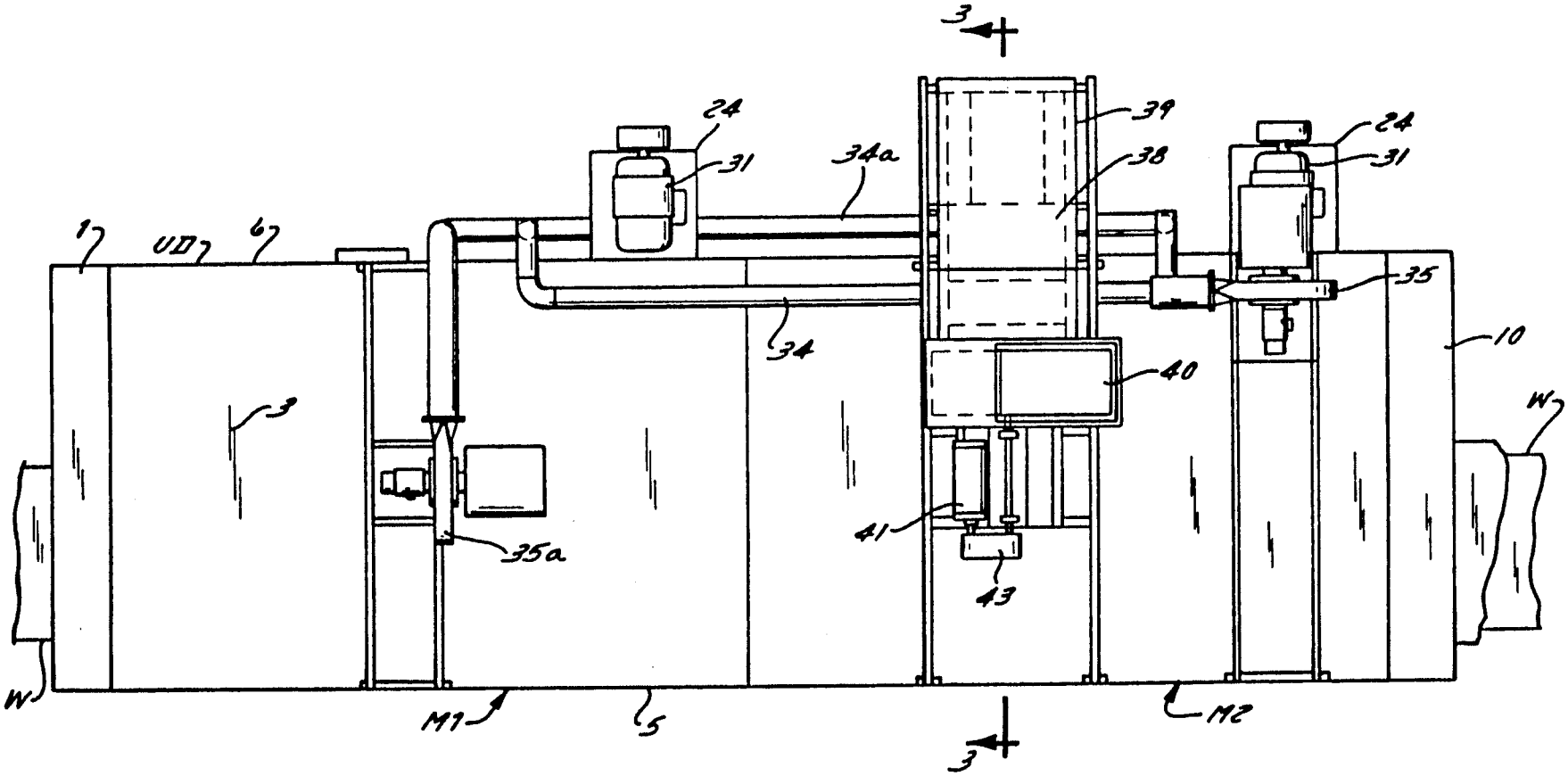
FIG. 2 is a plan view of the arrangement shown in FIG. 1.
Figure 5:
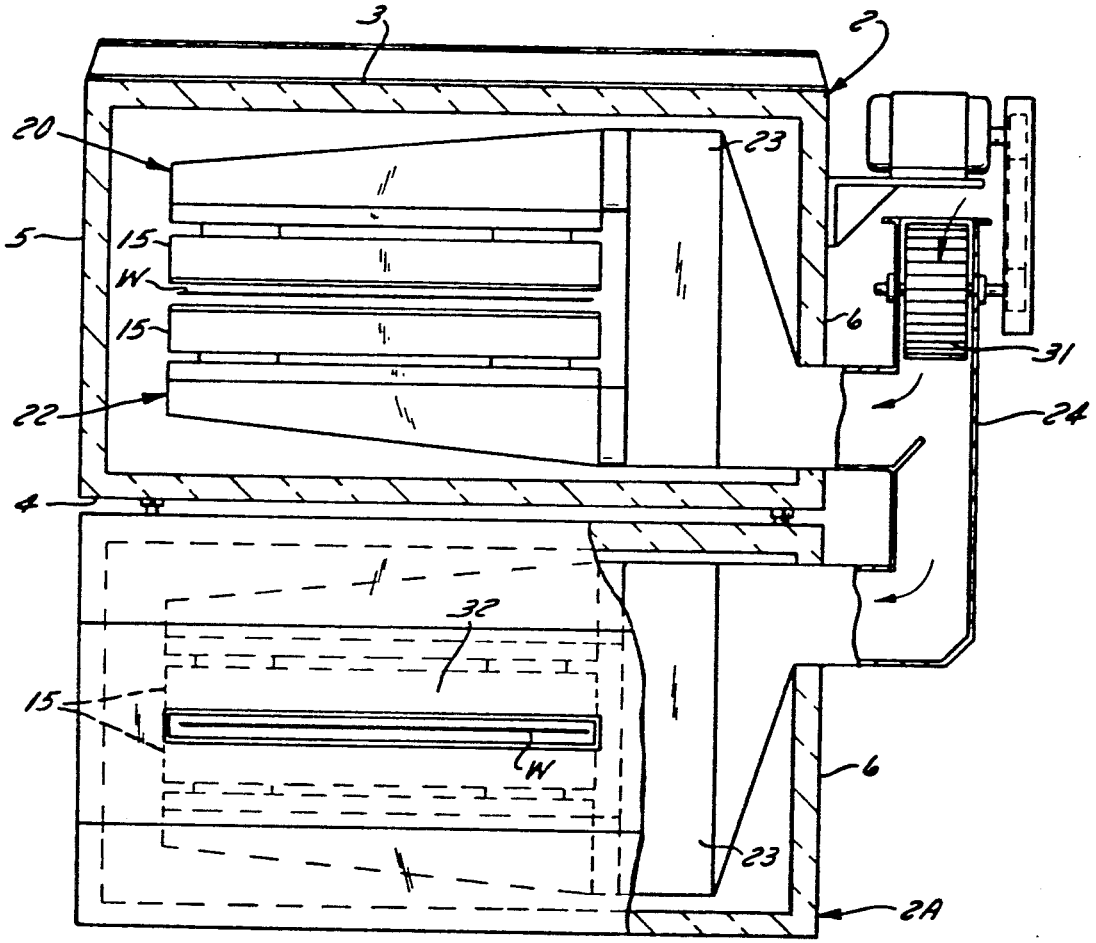
FIG. 5 is an end elevational view of the dryer, taken generally along line 5—5 in FIG. 1, certain parts being broken away or in section for the sake of clarity in the drawings.

The supply ducts 24 receive supply air from air supply fans 31 (FIGS. 2 and 5).

Figure 4:
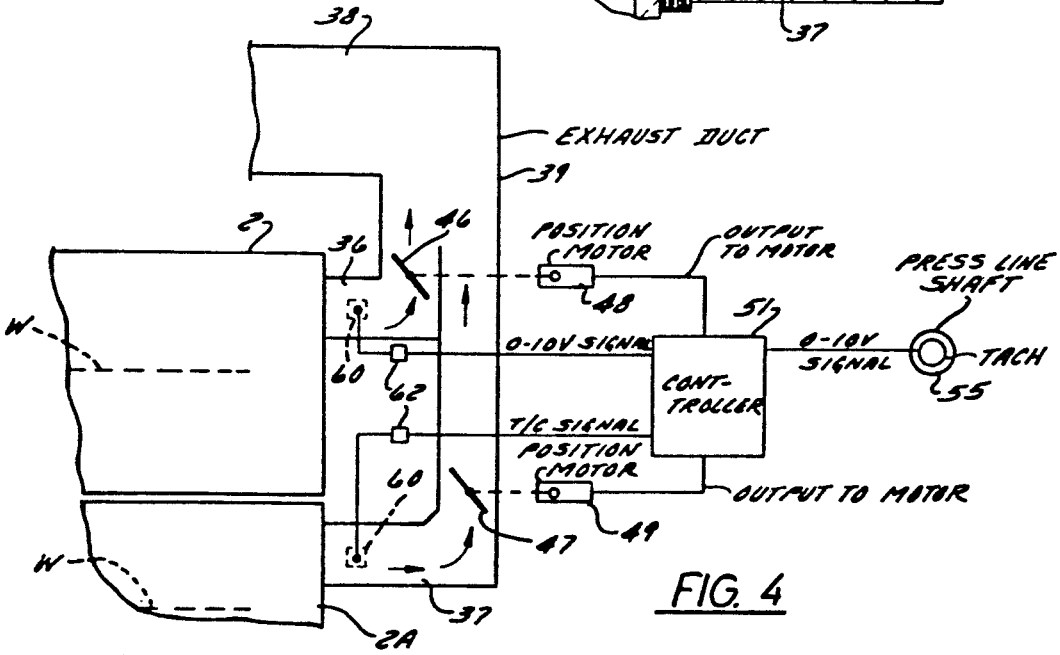
FIG. 4 is a fragmentary, schematic view of a portion of the dryer shown in FIG. 3, and also showing the exhaust flow rate control system of the present invention in schematic form.

A combustion blower 35 (FIGS. 1 and 2) supplies combustion air to the burners 33 via pipes 34. A similar air supply is provided for the lower housing 32, from combustion blower 35*a*, pipes 34*a* and to burners 33*a* as indicated. Thus the air supply ducts furnish heated pressurized air to each of the air bars for ultimate discharge against the web to dry the web and floatingly support it. A portion of the spent air that discharges from the air bar nozzles and into the general interior of the housing is drawn out of the upper and lower housings through the exhaust ducts 36 and 37, respectively, through housing 39, and then through the common duct 38 (FIGS. 2, 3 and 4) by means of the air exhaust blower 40 (FIGS. 1, 2 and 3) mounted on top of the housing 2. The remainder of the spent air is recirculated in the housing along with makeup air from the room.

Blower 40 is conventional, located on top of the upper housing 2 and is driven by an electric motor 41 through a conventional transmission 43.

In each of the exhaust ducts 36 and 37 (FIG. 4) extending from the interior of housings 2 and 2A, respectively, is positioned a valve in the form of a motorized pivotal damper 46, 47 (FIGS. 3 and 4) which can adjust the exhaust air flow. These dampers are adjusted by their electric position motors 48 and 49, respectively. The motors receive their command from a microprocessor based controller 51 which in turn receives its input from a speed sensor 55 (FIGS. 1 and 4), such as a tachometer or magnetic pickup, which reads the speed of the press from a suitable reference point, such as the drive shaft DS previously referred to. Another sensor 60, such as a mass air flow probe or pressure transducer, is located in each of the exhaust ducts 36 and 37 and feeds its input reading (air pressure) through a pressure transducer 62 and into the controller. The controller, by positioning the damper, adjusts the airflow in the exhaust ducts to the required value, for example, if the dryer is operating at one-half its maximum speed, then the exhaust rate flow will be reduced 50%. The controller is a single board computer or programmable logic controller (plc) consisting of a central processing unit (cpu) with the capabilities of sending and receiving various electrical signals to/from external equipment. In addition, the controller and these electrical signals are directly controlled by a set of computer instructions (software) designed specifically to achieve closed loop control of the dryer's exhaust rate. The language or style of programming used (Fortran, Basic or Ladder, etc.) will depend on the controller selected, but each set is designed specifically to achieve the desired end result. The specific closed loop error equation requires information on speed ratios $$\frac{\text{(actual)}}{\text{(max. allowable)}}$$

and pressure ratios $$\frac{\text{(actual)}}{\text{(max. design)}}$$

to calculate any errors. A generalized S-plane characterization of the error is as follows: $E_{(s)} = (K_D)S + (K_I)1/S + K_p$ where the K variables will vary per installation.

Recapitulation

In web dryers of the type to which this present invention relates, the exhaust system must be capable of handling the worse possible condition for solvent laden air. That worse condition occurs when there would be a web speed equal to the printing press maximum web speed while laying down maximum solvent onto the paper. The maximum speed would draw the most solvent laden paper through the dryer, while the heaviest laydown has the highest concentration of solvent. The present exhaust system removes this solvent from the dryer as it is evaporated from the web and the exhaust flow out of the dryer must be sufficient to remove the worse case solvent laden air situation. In actual practice, press speeds seldom reach their maximum and, instead, generally run at 60% to 80% of maximum. This reduction in speed directly and favorably reflects the concentration of solvent in the air; therefore, a reduction in speed results in the ability to use a reduction in exhaust flow rate. A reduction in the exhaust flow rate has several benefits to the user. Since the exhaust system is removing heated air from the dryer, less energy is required to maintain a set drying temperature because less heat would be removed from the dryer. When air is being exhausted from the dryer, other air must be substituted for it and this is referred to as makeup air, which makeup air is drawn from the area surrounding the dryer, that is, from the room from which the dryer is located. Thus, this room air must also be replaced and generally it is drawn from the outside of the plant which results in the necessity to either heat or cool it to maintain a comfortable working environment. Reducing this inflow of air into the plant will also reduce the operator's heating/cooling cost.

In addition, operators of this type of equipment are generally required to include pollution control devices on their exhaust systems. A majority of these systems currently on the market use energy based on the actual airflow through the system and not just on the solvent content of the air. Therefore, by reducing the airflow, some expense of the operator could be affected.

Thus, the controller provided by the present invention is an energy saving device for the operator and relates the exhaust requirement directly to the press speed. The new design incorporates a sensor to read the press speed, uses a sensor to read air pressure in the exhaust system and a motorized damper to adjust the airflow until it matches the required value. The present system is computer software controlled allowing for much greater versatility at less cost. The field man attending the machine simply sets the maximum exhaust rate to match the speed of the press selected, that is, at one-half the press speed the exhaust rate would be lowered 50%, thereby matching the exhaust to the speed.

What is claimed is:

1. Web drying equipment, including a dryer through which a web passes, said dryer having means for driving said web, web drying nozzles within the dryer for directing heated air against the web, air supply header means in the dryer and in air delivering communication with the said nozzles, said nozzles discharging heated air toward said web for supporting and drying said web, exhaust air duct means extending from the interior of the dryer for conveying spent air therefrom, the improvement comprising;

an exhaust flow rate control system for controlling the rate of flow of the spent air from the dryer, said system including (1) valve means in said exhaust duct means for varying the rate of air flow from said dryer, (2) a controller means for operating said valve means, (3) an air pressure sensor located in said exhaust duct for measuring air pressure therein and connected to and for sending a corresponding signal to said controller means, (4) a speed sensor connected to said means for driving said web and for measuring the speed of the web passing through said dryer and sending a corresponding signal to said controller means, whereby said controller means actuates said exhaust duct valve means in accordance with the signals received from said speed sensor and said air pressure sensor.

2. The apparatus set forth in claim 1 further characterized in that said air pressure located in said exhaust duct is a mass air flow sensor or pressure transducer and said speed sensor is a tachometer or magnetic pickup operatively connected with a drive shaft for said apparatus.

3. Apparatus for floatingly suspending and guiding a running web of indeterminate length through an elongated dryer, the dryer including a housing through which the web passes, said dryer having means for driving said web, a series of individual and elongated air bars located in the housing and spaced apart from one another along the length of the web, the bars being located at both the upper and lower sides of the web and arranged transversely to the web in the longitudinal direction of web travel, air supply header means in the housing and in air delivering communication with the air bars, said air bars discharging heated air toward said web for supporting the latter, and the spent air then passing into the interior of the housing, exhaust air duct means extending from the interior of the housing for conveying spent air from the housing, the improvement comprising;

an exhaust flow rate control system for controlling the rate of flow of the spent air from the housing, said system including (1) valve means in said exhaust duct means for varying the rate of air flow from said housing, (2) positioning means for adjusting said valve means, (3) a controller means for operating said positioning means, (4) an air pressure sensor located in said exhaust duct for measuring air pressure therein and connected to and for sending a corresponding signal to said controller means, (5) a speed sensor connected to said means for driving said web and for measuring the speed of the web passing through said housing and sending a corresponding signal to said controller means, whereby said controller means actuates said valve means by adjusting said positioning means in accordance with the signals received from said speed sensor and said air pressure sensor.

4. The apparatus set forth in claim 3 further characterized in that said air pressure sensor located in said exhaust duct is a mass air flow sensor or pressure transducer and said speed sensor is a tachometer or magnetic pickup operatively connected with a drive shaft for said apparatus.

5. A high velocity web dryer for floatingly suspending and guiding a running web of indeterminate length through the dryer, the dryer including a housing through which the web passes, said dryer having means for driving said web, a series of individual and elongated air bars located in the housing and spaced apart from one another along the length of the web, the bars being located at both the upper and lower sides of the web and arranged transversely to the web in the longitudinal direction of web travel, air supply header means in the housing and in air delivering communication with the air bars, said air bars discharging heated air toward said web for supporting the latter, and the spent air then passing into the interior of the housing, exhaust air duct means extending from the interior of the housing for conveying spent air from the housing, the improvement comprising;

an exhaust flow rate control system for controlling the rate of flow of the spent air from the housing, said system including (1) a pivotal damper valve in said exhaust duct means for varying the rate of air flow from said housing, (2) an electric positioning motor for adjusting said damper valve, (3) a controller means for operating said electric positioning motor, (4) a mass air flow pressure sensor located in said exhaust duct for measuring air pressure therein and connected to and for sending a corresponding signal to said controller means, (5) a speed sensor connected to said means for driving said web and for measuring the speed of the web passing through said housing and sending a corresponding signal to said controller means, whereby said controller means actuates said damper valve by adjusting said electric positioning motor in accordance with the signals received from said speed sensor and said mass air flow pressure sensor.

6. The apparatus set forth in claim 5 further characterized in that said mass air flow pressure sensor located in said exhaust duct is a mass air flow sensor or pressure transducer and said speed sensor is a tachometer or magnetic pickup operatively connected with a drive shaft for said apparatus.

* * * * *